US007290864B2

(12) United States Patent
King

(10) Patent No.: US 7,290,864 B2
(45) Date of Patent: Nov. 6, 2007

(54) HEATER CHIPS WITH A REDUCED NUMBER OF BONDPADS

(75) Inventor: David G. King, Shelbyville, KY (US)

(73) Assignee: Lexmark International, Inc., Lexington, KY (US)

( * ) Notice: Subject to any disclaimer, the term of this patent is extended or adjusted under 35 U.S.C. 154(b) by 271 days.

(21) Appl. No.: 11/241,079

(22) Filed: Sep. 30, 2005

(65) Prior Publication Data

US 2007/0076057 A1 Apr. 5, 2007

(51) Int. Cl.
*B41J 2/05* (2006.01)

(52) U.S. Cl. ..... 347/58; 347/50

(58) Field of Classification Search ..... 347/20, 347/50, 54, 56–59, 61–65, 67
See application file for complete search history.

(56) References Cited

U.S. PATENT DOCUMENTS 5,030,971 A * 7/1991 Drake et al. ..... 347/57
5,594,488 A 1/1997 Tsushima et al. ..... 347/208
5,646,660 A 7/1997 Murray ..... 347/59
5,731,828 A 3/1998 Ishinaga et al. ..... 347/62
5,812,162 A 9/1998 Silverbrook ..... 347/58
6,260,952 B1 7/2001 Feinn et al. ..... 347/50
6,357,863 B1 * 3/2002 Anderson et al. ..... 347/58
6,386,674 B1 5/2002 Corrigan, III et al. ..... 347/19
6,398,347 B1 6/2002 Torgerson et al. ..... 347/58
6,409,315 B2 * 6/2002 Komuro ..... 347/58
6,488,363 B2 12/2002 Torgerson et al. ..... 347/58
6,890,064 B2 5/2005 Torgerson et al. ..... 347/58
7,008,047 B2 * 3/2006 Conta et al. ..... 347/58

* cited by examiner

*Primary Examiner*—Juanita D. Stephens
(74) *Attorney, Agent, or Firm*—Sutherland, Asbill, Brennan

(57) ABSTRACT

Heater chips for use in printing devices, such as those including one or more ink vias and one or more heater arrays, where at least a portion of at least one the ink vias is associated with at least portions of at least two heater arrays. The first heater array can be adjacent to one side of at least a portion of the ink via and a second heater array can be adjacent to another side of at least a portion of the ink via. The heater chip can also include a bondpad supplying power to at least a portion of the first heater array and to at least a portion of the second heater array.

20 Claims, 3 Drawing Sheets

FIG. 1 [Prior Art]

FIG. 2 [Prior Art]

HEATER CHIPS WITH A REDUCED NUMBER OF BONDPADS

FIELD OF THE INVENTION

The present invention relates generally to heater chips in printheads, and more particularly, in one embodiment, heater chips having a reduced number of bondpads.

BACKGROUND OF THE INVENTION

A printhead is the device in printers, copiers, and multi-function products which sprays droplets of ink onto a sheet of paper. A number of printers, copiers, and multi-function products utilize heater chips in their printheads for discharging ink drops from one or more ink vias. Inkjet heater chips typically contain one or more ink vias as well as arrays of heaters located next to an ink via. The heaters provide thermal energy that causes the discharge of a droplet of ink. Chip bondpads are used to power the heaters by providing electric current to the heaters. Each chip bondpad usually has a corresponding tab circuit connection, tab trace, and electrical connection to the printing device.

The minimum number of bondpads required to power the heater arrays is determined by the amount of current required to fire the number of heaters simultaneously to achieve the desired performance in discharging ink droplets. Typically, in inkjet heater chips with one ink via, heater chip bondpads supply power only to heaters located on the same side of the ink via as the chip bondpads. Similarly, in inkjet heater chips containing multiple ink vias, a given bondpad supplies power to heaters on one side of the ink via or the other, but not both. Bondpads consume chip area. The on-chip routing of heater power from the bondpad to the heater arrays is also a contributing factor to overall chip size. The higher number of chip bondpads and power routes also increase the cost of the heater chip. Therefore, what is needed is a way to minimize the number of chip bondpads necessary to power the heater arrays on the chip.

BRIEF SUMMARY OF THE INVENTION

According to an embodiment of the invention, there is disclosed a heater chip for use in a printing device. The heater chip includes an ink via. A first heater array is adjacent at least a portion of one side of the ink via, and a second heater array is adjacent at least a portion of another side of the ink via. The heater chip also includes a bondpad, where the bondpad supplies power to at least a portion of the first heater array and to at least a portion of the second heater array.

According to one aspect of the invention, the heater chip may also include a second bondpad that supplies power to another portion of the first heater array and to a another portion of the second heater array. According to another aspect of the invention, the bondpad may supply power to the first heater array and the second heater array portions by power traces physically separated proximal to the bondpad. Additionally, each of the first and second heater arrays may include at least 320 heaters. According to yet another aspect of the invention, the bondpad supplies power to the first heater array and the second heater array by at least one power trace. Additionally, the first heater array and the second heater array may include a plurality of thin film resistors. Further, the heater chip may include a second ink via, and a third heater array associated with the second ink via, where the bondpad also supplies power to the third heater array.

According to another embodiment of the invention, there is disclosed a heater chip for use in a printing device. The chip includes an ink via, a first heater array and a second heater array adjacent at least a portion of the ink via, where the ink via is positioned between the first heater array and the second heater array, and a bondpad having at least two traces stemming from the bondpad. At least one of the traces is operatively connected to the first heater array and at least another one of the traces is operatively connected to the second heater array.

According to one aspect of the invention, the first and second heater arrays include a plurality of thin film resistors. The plurality of thin film resistors may be formed, at least in part, from a material selected from the group of materials consisting of platinum, gold, silver, copper, or aluminum, tantalum, titanium tungsten, silicon-nitrogen, silicon carbide, or diamond-like carbon coating. According to another aspect of the invention, each of the first and second heater arrays may contain at least 320 heaters. According to yet another aspect of the invention, the bondpad and the at least two traces are capable of supplying eight simultaneous fires per heater array. Additionally, the first and second heater arrays may each comprise a top portion and a bottom portion, and the bondpad may be operatively connected to the top portion of the first heater array and the top portion of the second heater array.

According to yet another aspect of the invention, the heater chip may include a second bondpad operatively connected to the bottom portion of the first heater array and the bottom portion of the second heater array. The heater chip may also include another ink via disposed between a third heater array and a fourth heater array, and a second bondpad coupled to a trace that is operatively connected to the third heater array and to a trace that is operatively connected to the fourth heater array. The traces coupled to the second bondpad can be physically separated proximal to the second bondpad.

According to yet another embodiment of the invention, there is disclosed a heater chip. The heater chip includes at least eight heater arrays, where the at least eight heater arrays include four heater array pairs, and where the arrays in each of the heater array pairs are disposed substantially adjacent opposing sides of at least a portion of an ink via. The heater chip also includes a plurality of bondpads operatively connected to the at least eight heater arrays, where at least one of the plurality of bondpads is operatively connected to both heater arrays within one of the heater array pairs.

According to one aspect of the invention, each of the at least eight heater arrays include a plurality of thin film resistors. According to another aspect of the invention, each of the at least eight heater arrays include at least 320 heaters. According to yet another aspect of the invention, each of the at least eight heater arrays comprises a top portion and a bottom portion, and some of the plurality of bondpads are operatively connected to the top portion of one of the at least eight heater arrays and the top portion of another one of the at least eight heater arrays. Additionally, some of the plurality of bondpads may be operatively connected to the bottom portion of one of the at least eight heater arrays and to the bottom portion of another one of the at least eight heater arrays.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention will now be described more fully hereinafter with reference to the accompanying figures, in which like numerals indicate like elements throughout the several drawings. Some, but not all embodiments of the invention are described. Indeed, these inventions may be embodied in many different forms and should not be construed as limited to the embodiments set forth herein; rather, these embodiments are provided so that this disclosure will satisfy applicable legal requirements.

An exemplary embodiment of the present invention is directed to a heater chip that includes heater power trace routes from a single bondpad to at least two different heater arrays located on both sides of an ink via. Specifically, the embodiment described herein minimizes the number of bondpads necessary to be fabricated on a heater chip and saves a significant amount of heater chip space particularly in heater chips requiring a very high number of heater elements, such as two thousand or more.

Figure 1:
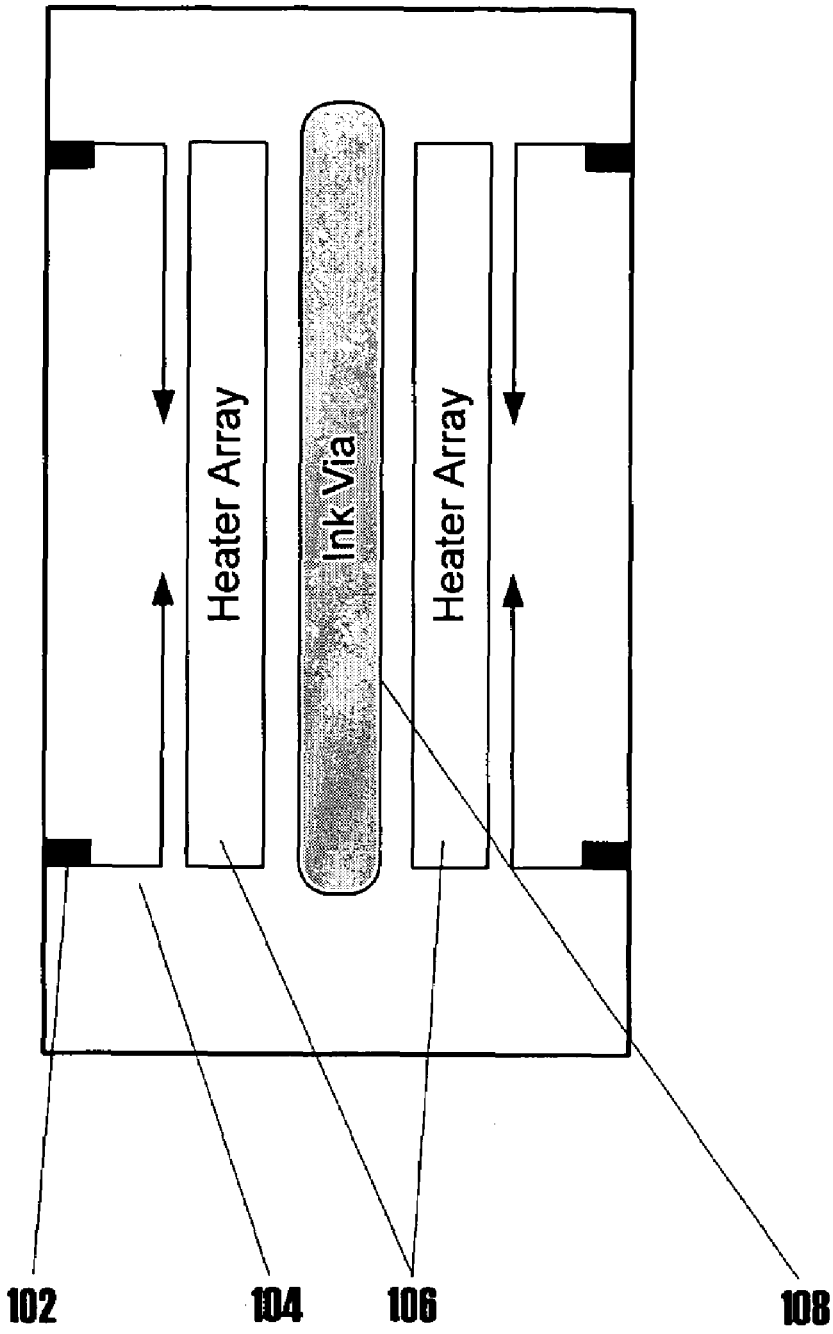
FIG. 1 is a block diagram of the configuration of heater arrays and routing of the connections to bondpads on a heater chip with only one ink via as it exists in the prior art.

FIG. 1 is an illustration of the configuration of heater arrays and routing of the connections to bondpads on a heater chip with only one ink via as it exists in the prior art. As illustrated in FIG. 1, four chip bondpads 102 are used to supply power to the heater arrays 106. Each bondpad 102 requires a tab circuit connection, a tab trace (also referred to as a power trace or interconnection) 104, and a connection to the printer head carrier. Power traces 104 and bondpads 102 are made of conductive material for the transfer of electric current to the heater arrays 106. Electrical current is supplied to the bondpad 102 from its external electrical connection to the printhead. The current is transferred to the heater array 106 through the power trace 104. The heater array 106 is an array of heaters which are heated as a result of being powered by the current received from the bondpad 102. In an exemplary embodiment of the invention, each of these heater arrays 106 may include a plurality of individual heaters fabricated as resistors in the heater chips.

For example, these resistors may be thin-film resistors in accordance with an exemplary embodiment of the invention. These thin-film resistors (or "heater stacks") may be formed of one or more materials, including platinum (Pt), gold (Au), silver (Ag), copper (Cu), aluminum (Al), tantalum (Ta), titanium tungsten (TiW), silicon-nitrogen (SiN), silicon carbide (SiC), diamond-like carbon (DLC) coating, etc. Other metals, alloys, or materials appreciable by one of ordinary skill in the art may also be used. The heaters may also be formed of other technologies besides thin-film resistors as known to those of ordinary skill in the art.

The heaters may also be referred to as thermal actuators. Further, the heater array 106 may be referred to as an actuator array. When the heaters in the heater arrays 106 are activated by the current provided from the bondpad 102, the heaters provide thermal energy to a nozzle chamber that contains the heaters. The nozzle chamber is in fluid communication with the ink via 108. Once the nozzle chamber is heated by the heaters, the ink via 108 discharges or "fires" a droplet of ink. Notably, in the prior art configuration of FIG. 1, each bondpad 102 sends current through its respective power trace 104 only to the heater array 106 that is on the same side of the ink via 108 as the bondpad 102 itself.

Figure 2:
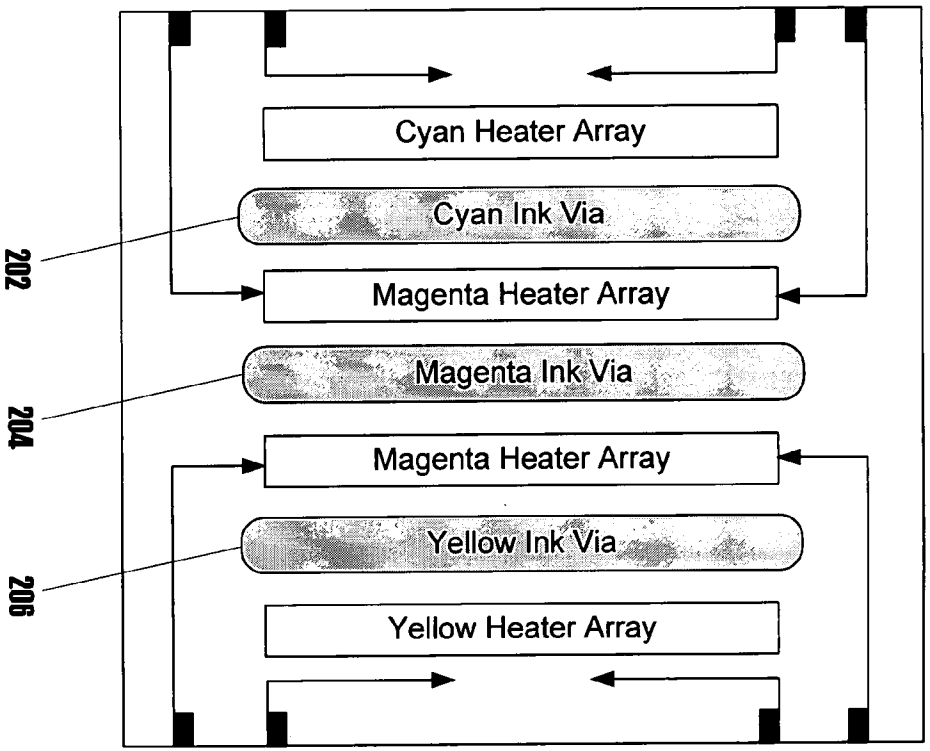
FIG. 2 is a block diagram of the configuration of heater arrays and routing of the connections to bondpads on heater chips with multiple ink vias as they exist in the prior art.

Similarly, prior art heater chips that contain multiple vias on the same chip, as shown in FIG. 2, also configure heater chip bondpads to supply power only to heater arrays located on the same side of the ink via as the chip bondpads. FIG. 2 shows a traditional heater chip that includes three ink vias—a cyan ink via 202, a magenta ink via 204, and a yellow ink via 206. As they exist in the prior art, the CMY (Cyan, Magenta, Yellow) color heater chip's bondpads supply power only to the heater array that is on the same side of the ink via as the bondpad itself. These conventional designs shown in FIGS. 1 and 2 are undesirable because chip bondpads consume chip area, as do the on-chip routing of power from the bondpads to the heater arrays.

Figure 3:
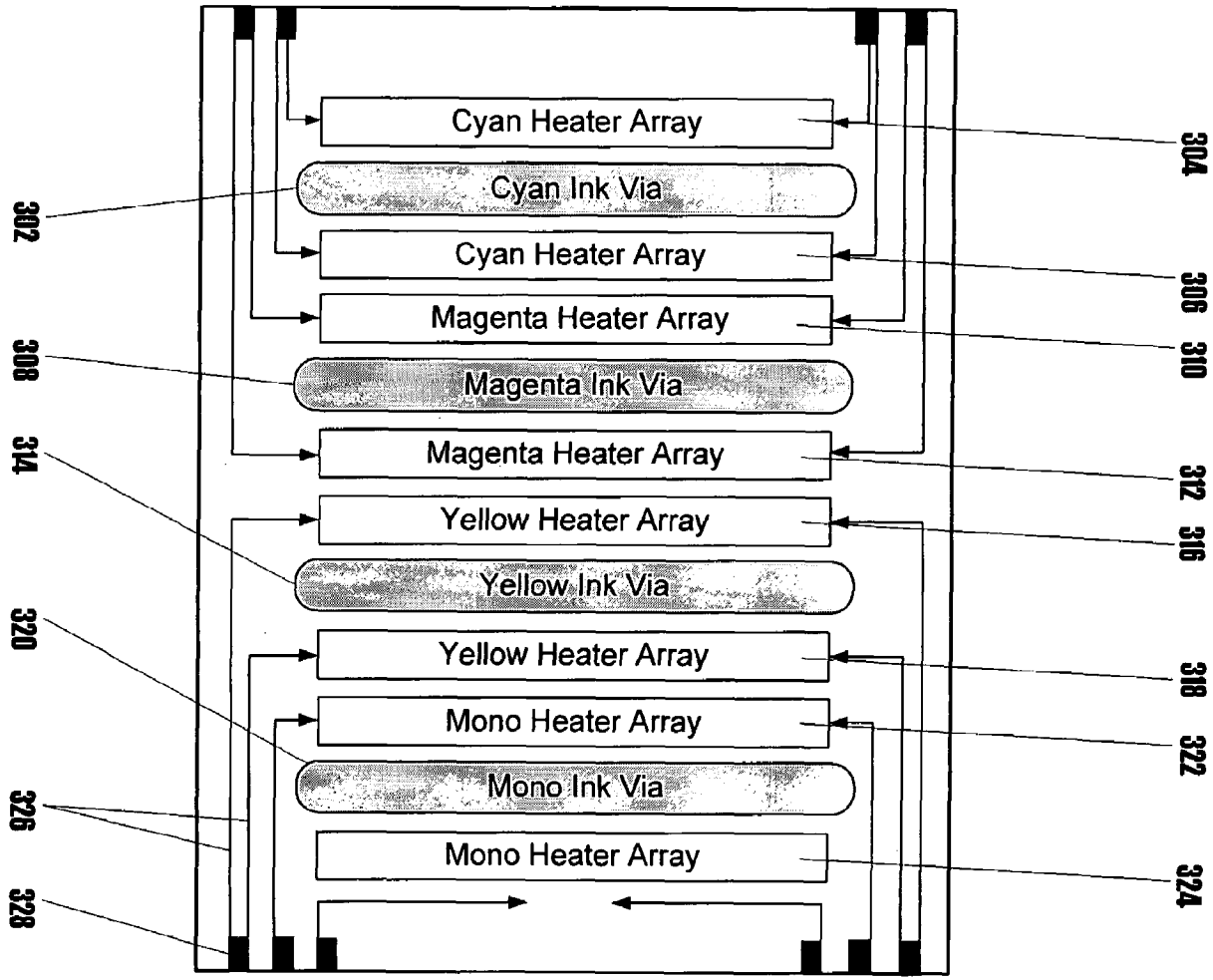
FIG. 3 shows a block diagram of the configuration of heater arrays and routing of the connections to bondpads on a heater chip with multiple ink vias in accordance with an illustrative embodiment of the present invention.

In contrast, FIG. 3 shows a block diagram of the configuration of heater arrays and routing of the connections to bondpads on a heater chip with multiple ink vias in accordance with an illustrative embodiment of the present invention. As illustrated in FIG. 3, a CMYK (cyan-magenta-yellow-monochrome) heater chip includes four ink vias each disposed between two heater arrays. In particular, a cyan ink via 302 is positioned between a first heater array 304 and a second heater array 306; a magenta ink via 308 is positioned between a first heater array 310 and a second heater array 312; a yellow ink via 314 is positioned between a first heater array 316 and a second heater array 318; and a monochrome (K) ink via 320 is positioned between a first heater array 322 and a second heater array 324. In an alternative embodiment of the present invention, different ink colors may be associated with one or more of the ink vias. Such ink colors may include red, green, photo CMY, or other ink colors appreciable by one of ordinary skill in the art.

One of ordinary skill in the art will also recognize that fewer or more ink vias and corresponding heater arrays may be utilized as necessary. As an example, an additional monochrome (K) ink via may be disposed between two additional heater arrays to form a CMYKK heater chip. In addition, in other embodiments of the invention, perhaps only a portion of the ink vias may be disposed between two heater arrays. For example, the monochrome ink via 320 may alternatively include only one monochrome heater array along a single side of the monochrome ink via 320. With the heater arrays positioned on both sides of at least a portion of the ink vias, the ink vias may provide smaller ink drops in order to achieve higher printing resolutions.

The heater arrays 304, 306, 310, 312, 316, 318, 322, and 324 illustrated in FIG. 3 may each contain a plurality of heaters. In an exemplary embodiment of the invention, a least a portion of the plurality of heaters within each heater array may be serially connected. One of ordinary skill in the art will also recognize that parallel connections may also be made with the heaters, depending on the desired routing characteristics of the heater arrays. In certain illustrative embodiments of the present invention, each of the heater arrays 304, 306, 310, 312, 316, 318, 322, and 324 may include an array of 320 heaters (for a total of 2560 heaters), although more or less heaters may be utilized in the heater arrays as necessary according to alternative embodiments of the present invention. In exemplary embodiments of the present invention, these 320 heaters may be grouped and/or addressed in blocks of 20 or 40 heaters each, although alternative groupings with varying numbers of heaters may also be utilized. In other embodiments, each of the heater arrays 304, 306, 310, 312, 316, 318, 322, and 324 may have varying numbers of heaters grouped in varying blocks. Many other variations to the heater arrays are readily apparent to one of ordinary skill in the art.

With the configuration of the heater arrays on each side of their corresponding ink via, as shown in the illustrative embodiment of FIG. 3, the amount of heaters needed to be fired simultaneously in each array has been reduced. Thus the amount of current needed to be supplied from the bondpads 328 to each heater array has been reduced to power the heater elements has also been reduced. Usually, bondpads are current limited to providing no more than approximately 1 Amp of current.

The minimum number of bondpads 328 required to power the heater arrays in the configuration of FIG. 3 is determined by the amount of current required to fire the maximum number of heaters simultaneously. In an exemplary embodiment of the present invention, the bondpads 328 are limited to supplying eight simultaneous fires given commonly used heater resistances. For example, the configuration of FIG. 3 requires only 8 simultaneous fires per 320 heaters, rather than 16 simultaneous fires per 320 heaters (required in several prior art configurations). Thus, the number of bondpads 328 required to fire the required number of heaters simultaneously has been reduced to the point that one bondpad 328 can supply the power needs of an entire array of heaters, or alternatively, to a portion of one heater array and a portion of a second heater array.

Using one bondpad 328 to power an entire heater array would require the use of greater chip area to ensure adequate power balance across the array. To save space on the heater chip, a bondpad 328 may be configured to supply power to the portions of two or more different arrays of heaters. For example, a bondpad may be configured to supply current to the top or bottom halves of two different heater arrays through the use of multiple power traces stemming from that bondpad. This configuration maintains the maximum current allowable for each bondpad, while minimizing the chip area needed for power balancing. By employing such a configuration, a single bondpad 328 supplies power not only to heaters in multiple heater arrays, but also to heaters on both sides of an ink via. For example, as shown in FIG. 3, employing this configuration with two power traces 326 stemming from a single bondpad 328 reduces the number of bondpads needed to power all the arrays from 16 to 10.

In an alternative embodiment of the present invention the number of bondpads may be reduced even further. For example, each bondpad 328 may have two power traces stemming from it, which would reduce the number of bondpads 328 in FIG. 3 from 10 to eight. In alternative embodiments, the bondpads may have more than two traces stemming from each of them supplying power to two or more heater arrays. This would drop the number of bondpads required even further, though such embodiments may have a direct impact on the efficiency and effectiveness of the ink via operation.

Further, as shown in the exemplary embodiment of FIG. 3, the power traces 326 are physically separated as they meet the bondpad 328. As is shown, it may be advantageous to utilize two separate power traces 326 from a single bondpad 328 to efficiently balance the series resistance of the power traces 326. This ensures adequate power balancing to the heater arrays. Additionally, the on-chip routing of power traces 326 from a single bondpad 328 may also be positioned close together, and more closely than conventional power traces stemming from different bondpads. Although not illustrated, it should also be appreciated that a single power trace may extend from the bondpad 328, and then branch into two or more traces that extend to respective heater arrays. The on-chip routing shown and described with reference to FIG. 3 may be implemented in many other heater chip configurations containing any number of ink vias. Further, it is appreciated that in alternative embodiments a bondpad may have multiple (more than two) power traces stemming from its tab circuit connection which provide current to several heater arrays located on the heater chip.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A heater chip for use in a printing device, comprising:
an ink via;
a first heater array adjacent at least a portion of one side of the ink via;
a second heater array adjacent at least a portion of another side of the ink via; and
a bondpad, wherein the bondpad supplies power to at least a portion of the first heater array and to at least a portion of the second heater array.

2. The heater chip of claim 1, further comprising a second bondpad, wherein the second bondpad supplies power to another portion of the first heater array and to another portion of the second heater array.

3. The heater chip of claim 1, wherein the bondpad supplies power to the first heater array and the second heater array portions by power traces physically separated proximal to the bondpad.

4. The heater chip of claim 1, wherein each of the first and second heater arrays comprise at least 320 heaters.

5. The heater chip of claim 1, wherein the bondpad supplies power to the first heater array and the second heater array by at least one power trace.

6. The heater chip of claim 1, wherein the first heater array and the second heater array each include a plurality of thin film resistors.

7. The heater chip of claim 1, further comprising a second ink via, and a third heater array associated with the second ink via, and wherein the bondpad supplies power to the third heater array.

8. A heater chip for use in a printing device, comprising
an ink via;
a first heater array and a second heater array adjacent at least a portion of the ink via, wherein the ink via is positioned between the first heater array and the second heater array; and
a bondpad having at least two traces stemming from the bondpad, wherein at least one of the traces is operatively connected to the first heater array and at least another one of the traces is operatively connected to the second heater array.

9. The heater chip of claim 8, wherein the at least two traces are physically separated proximal to the bondpad.

10. The heater chip of claim 8, wherein the first and second heater arrays include a plurality of thin film resistors formed, at least in part, from a material selected from the group of materials consisting of platinum, gold, silver, copper, aluminum, tantalum, titanium tungsten, silicon-nitrogen, silicon carbide, and diamond-like carbon.

11. The heater chip of claim 8, wherein each of the first and second heater arrays contain at least 320 heaters.

12. The heater chip of claim 11, wherein the bondpad and the at least two traces are capable of supplying eight simultaneous fires per heater array.

13. The heater chip of claim 8, wherein the first and second heater arrays each comprise a top portion and a bottom portion, and wherein the bondpad is operatively connected to the top portion of the first heater array and the top portion of the second heater array.

14. The heater chip of claim 13, further comprising a second bondpad operatively connected to the bottom portion of the first heater array and the bottom portion of the second heater array.

15. The heater chip of claim 8, further comprising:

another ink via disposed between a third heater array and a fourth heater array; and a second bondpad coupled to a trace that is operatively connected to the third heater array and to a trace that is operatively connected to the fourth heater array, wherein the traces coupled to the second bondpad are physically separated proximal to the second bondpad.

16. A heater chip comprising:

at least eight heater arrays, wherein the at least eight heater arrays comprise four heater array pairs, and wherein the arrays in each of the heater array pairs are disposed substantially adjacent opposing sides of at least a portion of an ink via; and a plurality of bondpads operatively connected to the at least eight heater arrays, wherein at least one of the plurality of bondpads is operatively connected to both heater arrays within one of the heater array pairs.

17. The chip of claim 16, wherein each of the at least eight heater arrays comprises a plurality of thin film resistors.

18. The chip of claim 16, wherein each of the at least eight heater arrays comprises at least 320 heaters.

19. The chip of claim 16, wherein each of the at least eight heater arrays comprises a top portion and a bottom portion, and wherein some of the plurality of bondpads are operatively connected to the top portion of one of the at least eight heater arrays and the top portion of another one of the at least eight heater arrays.

20. The chip claim 19, wherein some of the plurality of bondpads are operatively connected to the bottom portion of one of the at least eight heater arrays and to the bottom portion of another one of the at least eight heater arrays.

* * * * *